United States Patent [19]

Wright et al.

[11] Patent Number: 4,720,958

[45] Date of Patent: Jan. 26, 1988

[54] OBJECT ALIGNING AND PACKING SYSTEM

[75] Inventors: Andrew K. Wright; Steven C. Forberger, both of Lancaster, Pa.

[73] Assignee: RCA Corporation, Princeton, N.J.

[21] Appl. No.: 19,161

[22] Filed: Feb. 26, 1987

[51] Int. Cl.[4] ..... B65B 35/36; B65B 61/22

[52] U.S. Cl. ..... 53/157; 53/537; 53/540; 53/244; 53/252

[58] Field of Search ..... 53/157, 447, 538, 537, 53/540, 154, 244, 250, 252, 251

[56] References Cited

U.S. PATENT DOCUMENTS

| | | | |
|---|---|---|---|
| 3,941,236 | 3/1976 | Hagedorn | 53/537 X |
| 4,043,097 | 8/1977 | Ishida et al. | 53/157 X |
| 4,236,855 | 12/1980 | Wagner et al. | 53/157 X |
| 4,514,956 | 5/1985 | Varallo et al. | 53/157 X |
| 4,584,821 | 4/1986 | Booth | 53/157 X |

*Primary Examiner*—James F. Coan

*Attorney, Agent, or Firm*—E. M. Whitacre; D. H. Irlbeck; L. L. Hallacher

[57] ABSTRACT

A system for aligning and packing substantially flat objects moving on a conveyor line in irregularly spaced and, nonaligned rows includes a mechanism for separating the rows and aligning the objects and also for feeding the aligned objects onto another conveyor. A packing mechanism transfers the aligned objects from a loading area to a container. An additional device places a strip of protective material on top of the layer of objects. A moving means vertically moves the container a distance substantially equal to the thickness of the object being packed in preparation for the reception of an additional layer of objects. Another transfer device moves the filled container from the loading area and replaces it with an empty container. Another transfer moves the filled container to provide room for the next container and an additional device transfers a supply of empty containers in preparation for another container being placed in the loading area.

24 Claims, 15 Drawing Figures

OBJECT ALIGNING AND PACKING SYSTEM

BACKGROUND

This invention relates generally to packing systems and particularly to a system for aligning and packing substantially flat objects.

An important area for automation is packaging. Frequently, manufactured parts move along conveyor lines to an area where they are packed for shipment. In order to automatically pack the parts, it is necessary that they be properly oriented and aligned at some point before they are transferred to a shipping container. An example of parts which lend themselves to automatic packing are the ceramic beads which are used to hold the various electrodes of electron guns in the required spacing and orientation. The ceramic beads typically are substantially rectangular flat pieces. The beads are made of a formable material and passed through an oven where they are hardened. The beads travel on a conveyor through the oven and typically are arranged in nonaligned, irregularly spaced rows which extend transversely across the conveyor. The hardened ceramic beads are conveyed through an inspection area to a packing area where the beads are loaded into containers. Automatic packing of the finished beads requires that the beads be properly aligned on the conveyor prior to reaching the packing area. The present invention therefore is directed toward a system for aligning and packing substantially flat objects which initially are nonaligned and are arranged irregularly spaced rows.

SUMMARY

A system for aligning and packaging substantially flat objects moving along a first conveyor nonaligned in irregularly spaced rows includes an object aligning and separating mechanism for separating rows of objects and for aligning the objects in rows substantially normal to the conveyor and also for feeding the objects onto a second conveyor. A transfer mechanism transfers a preselected number of the objects from the second conveyor to a container located at a loading area. A container moving means vertically moves the container a distance substantially equal to the thickness of the objects whereby a plurality of layers of objects are stacked in the container. A strip of protective material is placed between each of the layers of objects in the conatiner.

DETAILED DESCRIPTION

Figure 1:
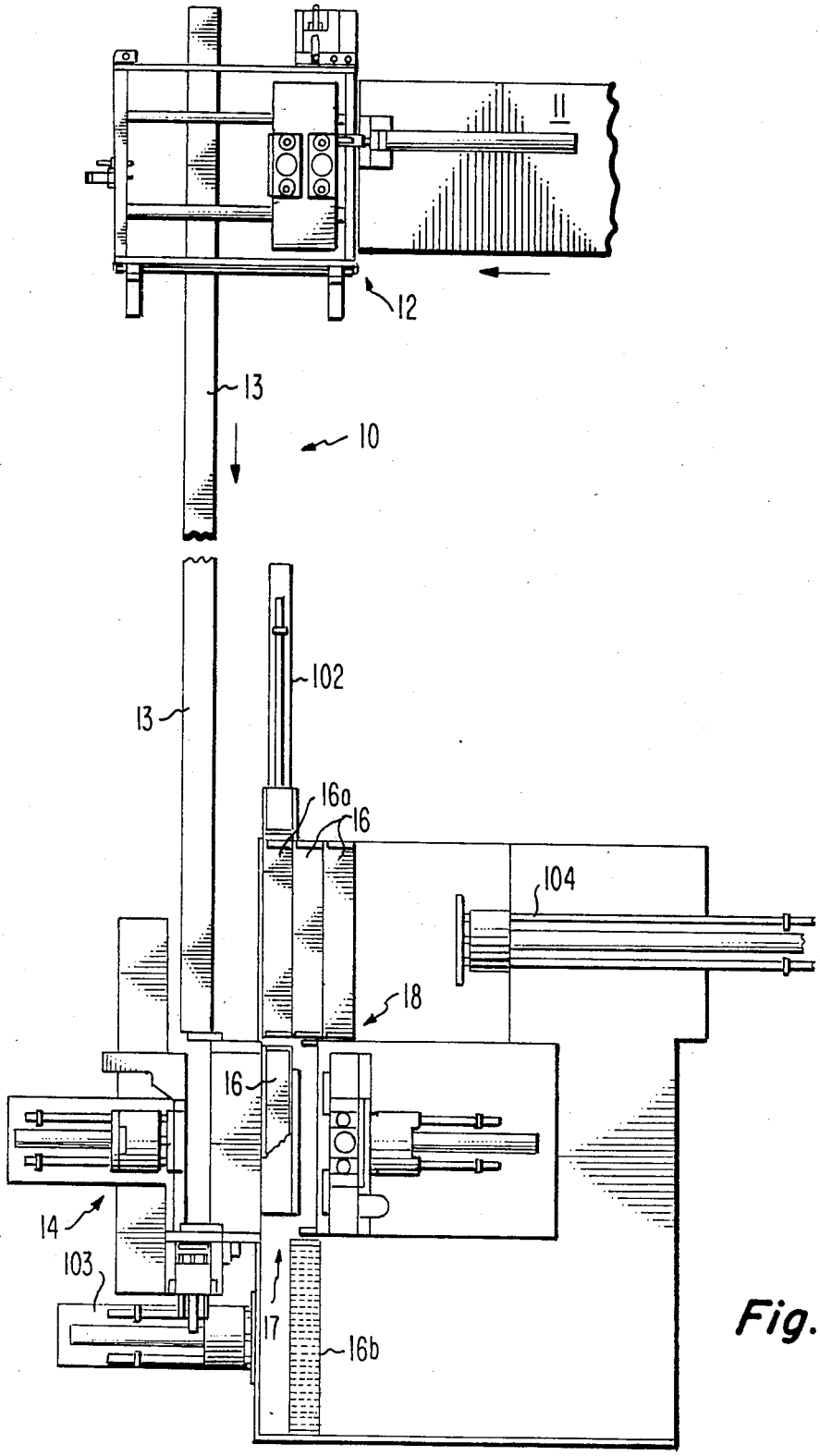
FIG. 1 is a top view of a preferred embodiment for a system of aligning and packing flat objects.

In FIG. 1, a system 10 for automatically aligning and packing substantially flat objects includes a first conveyor 11 upon which the objects to be aligned and packed are conveyed in a manner more fully described hereinafter with respect to FIG. 7. The system 10 includes an object aligning and separating mechanism 12 which separates the irregular rows of objects on the conveyor 11 and aligns the objects within the separated row prior to conveying the aligned rows of objects onto a second conveyor 13. The mechanism 12 is more fully described hereinafter with respect to FIGS. 2*a*, 2*b* and 2*c*. The conveyor 13 conveys the aligned objects to a packing mechanism 14 which transfers a preselected number of the aligned objects from the conveyor 13 to a container 16. The packing mechanism 14 is described in detail hereinafter with respect to FIGS. 3*a*, 3*b* and 3*c*. The container 16 is supported on a moving device 17 which is used to vertically move the container 16 after each layer of objects is transferred to the container 16. The moving means 17 is described in detail hereinafter with respect to FIG. 5*a*, 5*b* and 5*c*. A device 18 is used to place a strip of protective material onto each layer of objects within the container 16 to prevent the objects from being scratched. The device 18 is described hereinafter with respect to FIGS. 4*a*, 4*b* and 4*c*.

Throughout the inventive system 10 a plurality of prior art transfer devices are used. Such a prior art transfer device 19 is shown in detail in FIG. 6. The transfer device 19 includes a cylinder 21 having a shaft 22. A support 23 is coupled to the cylinder 21. Slide rods 24 and 26 are arranged on opposite sides of, and parallel to the cylinder 21. Slide bearings 27 are affixed to the support 23 and are slideably arranged on the rod 24. Similar slide bearings 28 are also fixed to of the support 23 and slide on the rod 26. The support 23 is fixed and the slide rods 24 and 26 are moveable in a direction parallel to the longitudinal axis of the cylinder 21 and are stabilized by the slide bearings 27 and 28. A plate 29 is affixed to the ends of the shaft 22 and the rods 24 and 26 to move when the cylinder 21 is actuated. The plate 29 is configured and dimensioned in accordance with the configuration and dimensions of the item being transferred by the transfer device 19. Proximity switches 31 and 32, which can be magnetic switches, are affixed to the cylinder 21 to sense the position of a piston within the cylinder 21 when various items pass within the proximity of the switches.

Figure 7:
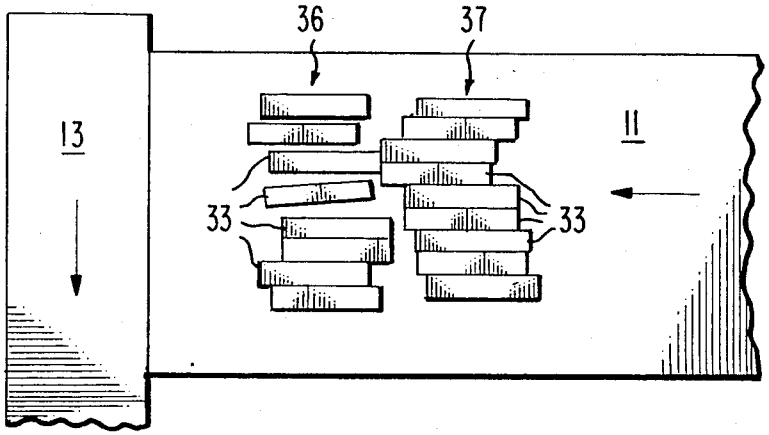
FIG. 7 shows several rows of substantially flat rectangular objects arranged in irregular rows and spacings along a conveyor.

In FIG. 7, a plurality of objects 33 move along a conveyor 11 for transfer to a second conveyor, such as conveyor 13. The objects are arranged in irregular rows 36 and 37 and the objects within the two rows are irregularly spaced. Although only two rows 36 and 37 of the objects 33 are shown, it should be understood that a large number of rows typically would be present on the conveyor 11. The number of objects 33 within each of the rows is not critical to the invention. With the invention, the row 36 is separated from the row 37 and each of the objects 33 within row 36 is aligned in a direction transverse to the conveyor 11 prior to the objects being transferred to the conveyor 13. Subsequently, the row 37 is separated from the succeeding row and the individual objects within the row 37 are aligned transversely of the conveyor 11.

Figure 2A:
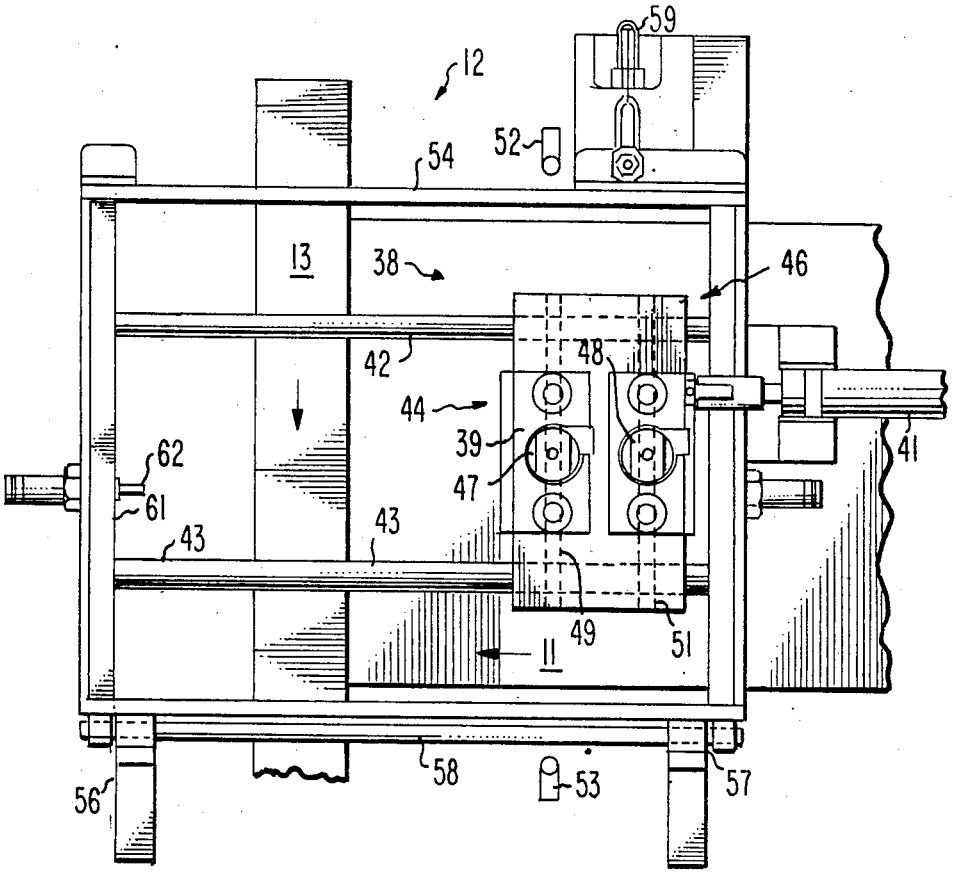
FIG. 2*a* is a top view of a preferred embodiment of a mechanism for separating and aligning rows of objects.
Figure 2B:
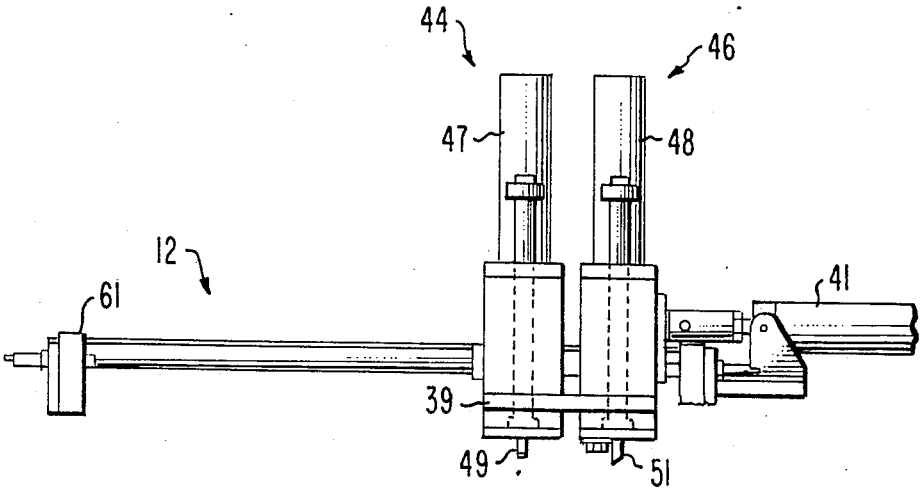
FIG. 2*b* is a side view of a mechanism of FIG. 2*a*.
Figure 2C:
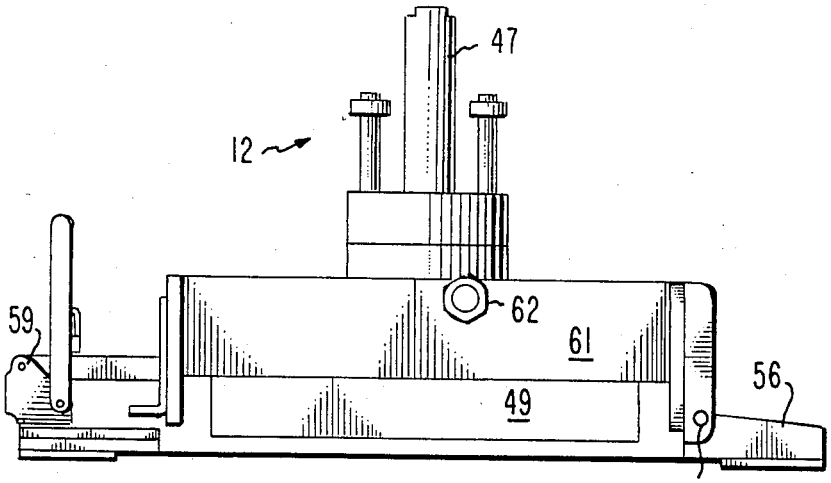
FIG. 2*c* is a front view of the mechanism of FIG. 2*a*.

The mechanism 12 which separates the rows of objects 33 and transversely aligns the objects 33 with respect to the conveyor 11 is shown in detail in FIGS. 2*a*, 2*b* and 2*c*. The object aligning and separating mechanism 12 includes a transfer device 38, which is similar in construction to the transfer device 19 described with respect to FIG. 6. The transfer device 38 includes a support plate 39, a cylinder 41 and slide rods 42 and 43. The support plate 39 supports two additional transfer devices 44 and 46 which are similar to the transfer device 19 of FIG. 6. Transfer device 46 includes a cylinder 47 and the transfer device 47 includes a cylinder 48. The two transfer devices 44 and 46, respectively, have cylinders 47 and 48 arranged vertically so that the shafts of the cylinders 47 and 48 move vertically with respect to the conveyor 11. Actuation of the cylinder 41 causes both cylinders 47 and 48 to simultaneously move parallel to the direction of motion of the conveyor 11. The shaft (not shown) of the cylinder 47 supports an elongated row separating member 49. The separating member 49 preferably is an elongated blade which extends substantially the full width of the conveyor 11. The blade 49 is made of a material which has a high coefficient of friction and which is somewhat resilient, such as firm rubber. When the cylinder 47 is actuated, the shaft moves downwardly and the blade 49 contacts the objects 33 within one row at a position in the proximity of the center of the objects. Actuation of the cylinder 41 causes the plate 39, and thus the cylinders 47 and 48, to move in the same direction as the motion of the conveyor 11 and at a rate faster than that of the conveyor 11. The rapid motion of the blade 49 in contact with the objects 33 causes one complete row of objects to be separated from the row of objects immediately following the contacted row.

The shaft (not shown) of the cylinder 48 supports an elongated object aligning member 51. The object aligning member 51 preferably is a elongated blade extending substantially the full width of the conveyor 11 and is made of a hard non-deformable material. Actuation of the cylinder 48 causes the blade 51 to move downwardly toward the conveyor 11 and position blade 51 behind the separated row of objects 33 on the conveyor 11. The cylinder 47 is actuated to raise the separating blade 49 from the objects. At this point, the objects 33 are no longer moved by the blade 49 and the blade 51 therefore "catches" the objects. The blade 51 contacts the back edges of the objects 33 and aligns the objects transversely across the conveyor 11.

A light source 52 and a light detector 53 are arranged on opposite sides of the transfer device 38 and are set at a level to detect the rows of objects 33 as they approach the cylinder 47 when the cylinder 41 is in the initial position illustrated in FIG. 2*a*.

The object separating and aligning mechanism 12 includes a frame 54 which supports the transfer mechanism 38. Mounting bearings 56 and 57 are fixed to a fixed support (not shown). A shaft 58 is fixed to the frame 54 and is supported by the bearings 56 and 57. The frame 54 therefore is pivotable about the shaft 58 to enable the separating and aligning mechanism 38 to be pivoted upwardly for easy maintenance of the blades 49 and 51. A dead-over-center clamp 59 holds the separating and aligning mechanism 12 in the operating position during normal operation.

The distal end 61 of the frame 54 is spaced from the second conveyor 13 at a distance which provides room for the support plate 39 as the blade 51 pushes a row of objects 33 onto the second conveyor 13. A sensor 62 can be used to detect the support plate 39 to avoid over travel of the mechanism. Additionally, the travel of the support plate 39 can be limited by the stroke of the cylinder 41.

Figure 3A:
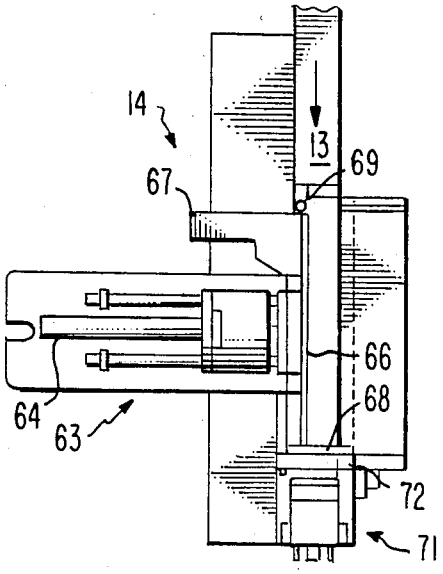
FIG. 3*a* is a top view of a preferred embodiment of a transfer mechanism for transferring objects to a container.
Figure 3B:
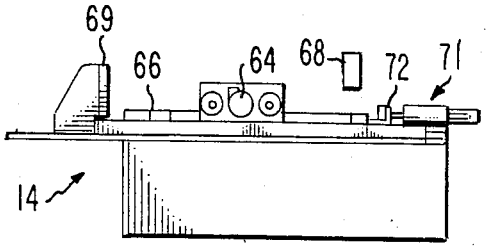
FIG. 3*b* is a view of the transfer mechanism of FIG. 3*a*.
Figure 3C:
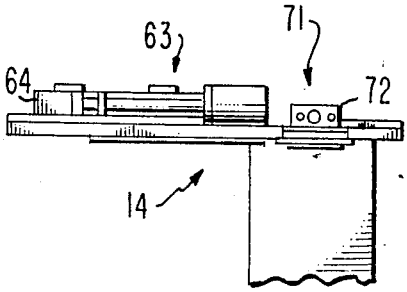
FIG 3*c* is an end view of the transfer mechanism of FIG. 3*a*.

The packing mechanism 14 is shown in detail in FIGS. 3*a*, 3*b* and 3*c*. The packing mechanism 14 includes a transfer device 63, which is similar in construction to the transfer device 19 described with respect to FIG. 6. The transfer device 63 includes a cylinder 64 having a shaft (not shown). A pusher plate 66 is mounted to the shaft of the cylinder 64 and has a length which is determined by the number of objects desired to be loaded upon a single actuation of the cylinder 64. An object stop 67 is supported by the pusher bar 66 in the proximity of the end of the pusher bar 66 closest to the input end of the packing mechanism 14. A sensor 68 is arranged at the far end of the pusher bar 66. Another sensor 69 is arranged at the other end of the pusher bar 66. The sensor 68 detects the presence of the first object which arrives at a loading position defined by the pusher bar 66. The sensor 69 detects the last object which enters the loading area so that, when a preselected number of objects is present in the loading area the cylinder 64 of the transfer device 63, is actuated to push the objects from the conveyor 13 to a container 16 (FIG. 1).

Figure 6:
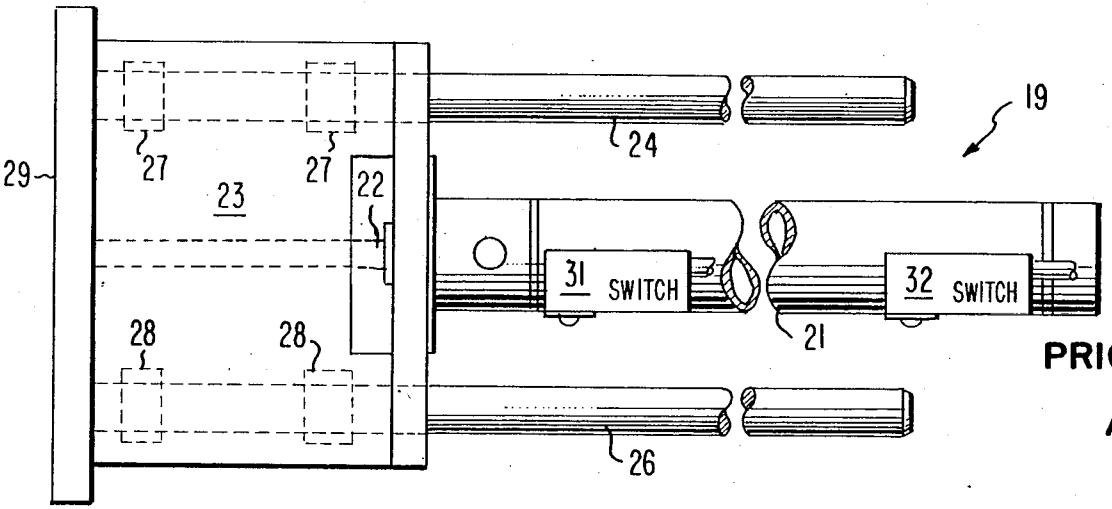
PRIOR ART Fig.6
FIG. 6 shows a prior art transference device of a type used throughout the invention.

Another transfer device 71, which is similar to the device 19 described with respect to FIG. 6, is arranged at one end of the transfer bar 66. The shaft of the transfer device 71 supports an end plate 72. The end plate 72 inhibits the motion of the objects on the conveyor 34 to cause the objects 33 to line up in the loading area defined by the pusher bar 66. After the preselected number of objects has entered the loading area, the cylinder of the transfer device 71 is actuated to retract the end 72 away from the object which previously contacted the end 72. This action relieves any pressure between the objects and the device to permit smooth movement of the objects off the conveyor 13.

Figure 4A:
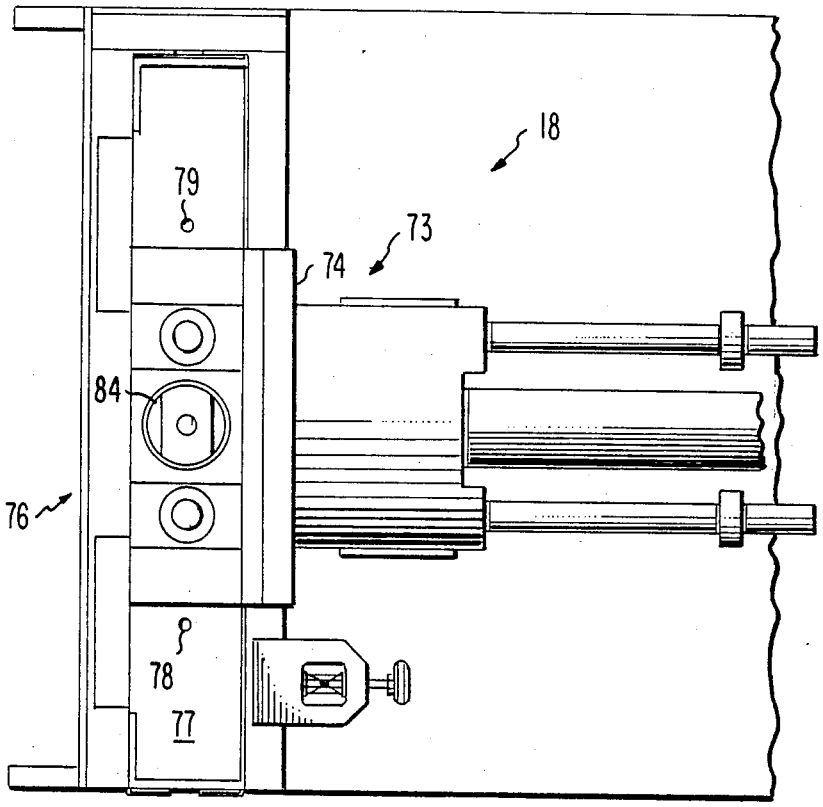
FIG 4*a* is a top view of a device for placing a strip of protective material between layers of objects.
Figure 4B:
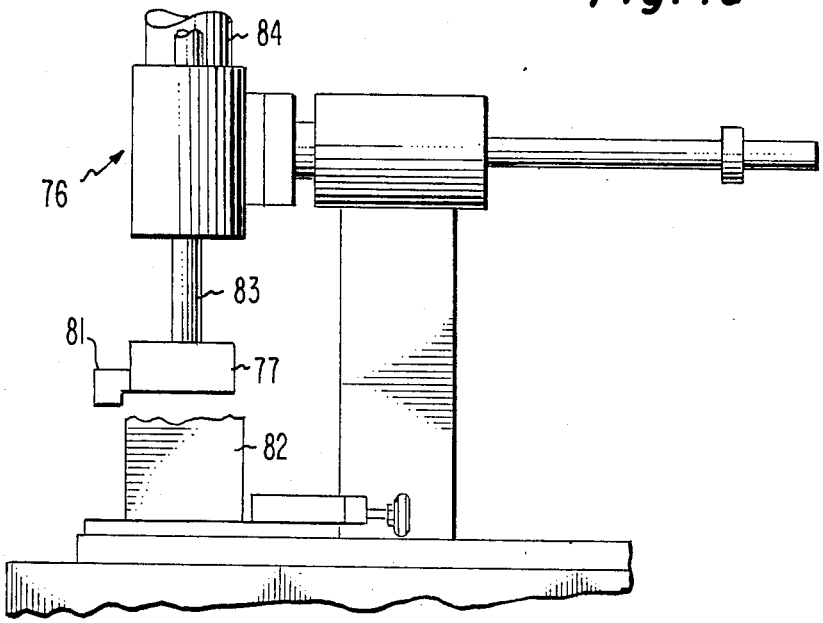
FIG. 4*b* is a side view of the device of FIG. 4*a*.
Figure 4C:
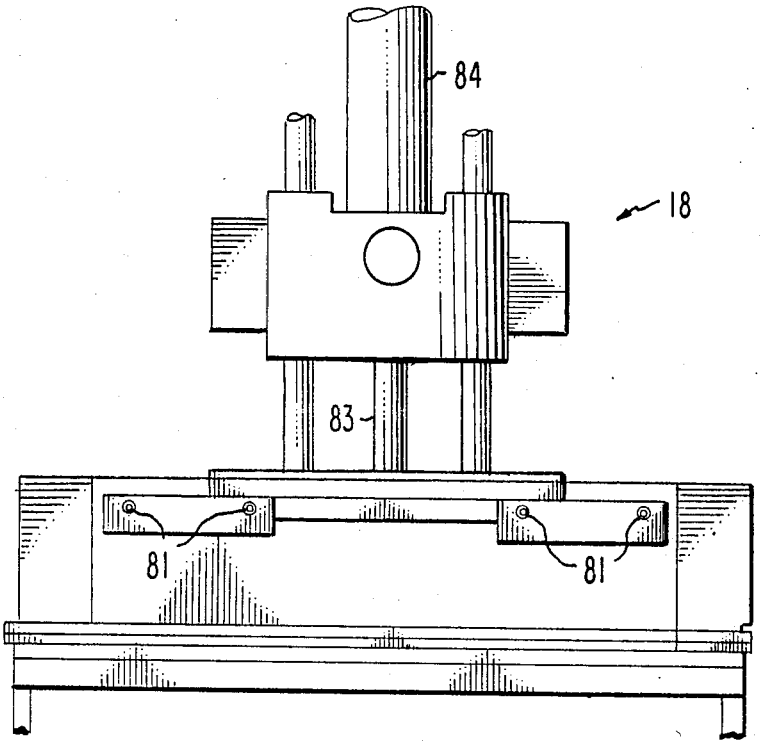
FIG. 4*c* is a front view view of the device of FIG. 4*a*.

The device 18 for placing a strip of protective material onto a layer of the objects 33 within the container 16 is shown in detail in FIGS. 4*a*, 4*b* and 4*c*. The device 18 includes a transfer device 73 which also is similar to the transfer device 19 explained with respect to FIG. 6. The support plate 74 of the transfer device 37 supports a vertically arranged transfer device 76, which also is similar to the transfer device 19 described with respect to FIG. 6. The support plate 77 of the transfer device 76 includes outlets 78 and 79 which are used to create a vacuum on the bottom side of the support plate 77. An air outlet 81 also is fixed to the support plate 77. A container 82 is arranged beneath the support plate 77 and contains a supply of strips of protective material, such as paper. When the cylinder 84 of the transfer device 76 is actuated, the shaft 83 moves downwardly to move the support plate 77 downwardly into contact with the supply of protective strips within the container 82. A vacuum is created to remove air through the orifices 78 and 79 to create a vacuum which enables the device to pick up a strip of the protective material. A short blast of air is injected out of the outlet 81 to blow any excess strips apart so that only one strip of protective material is picked up at a given time. The shaft 83 is retracted into the cylinder 84 to raise the support 77. The cylinder 75 of the transfer device 73 is energized to move the support plate 77 over the container 16 of objects. The shaft 83 is again lowered and the vacuum removed from the orifices 78 and 79 to cause the strip of protective material to be placed upon the layer of objects within the container 16. The transfer devices 73 and 74 are actuated to retract the device 18 to the rest position in preparation of placing a strip of protective material on the next layer of objects within the container 16.

Figure 5A:
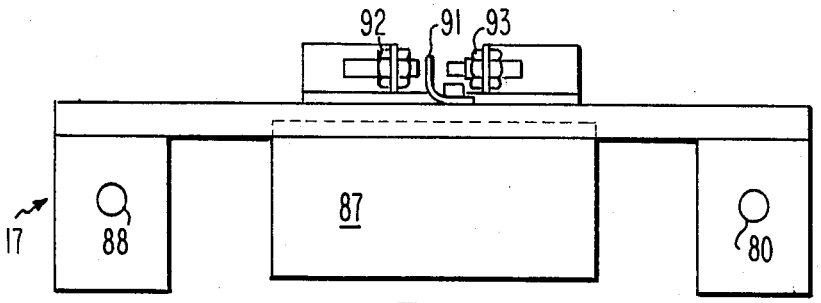
FIG. 5*a* is a top view of a device for vertically moving an object container.
Figure 5B:
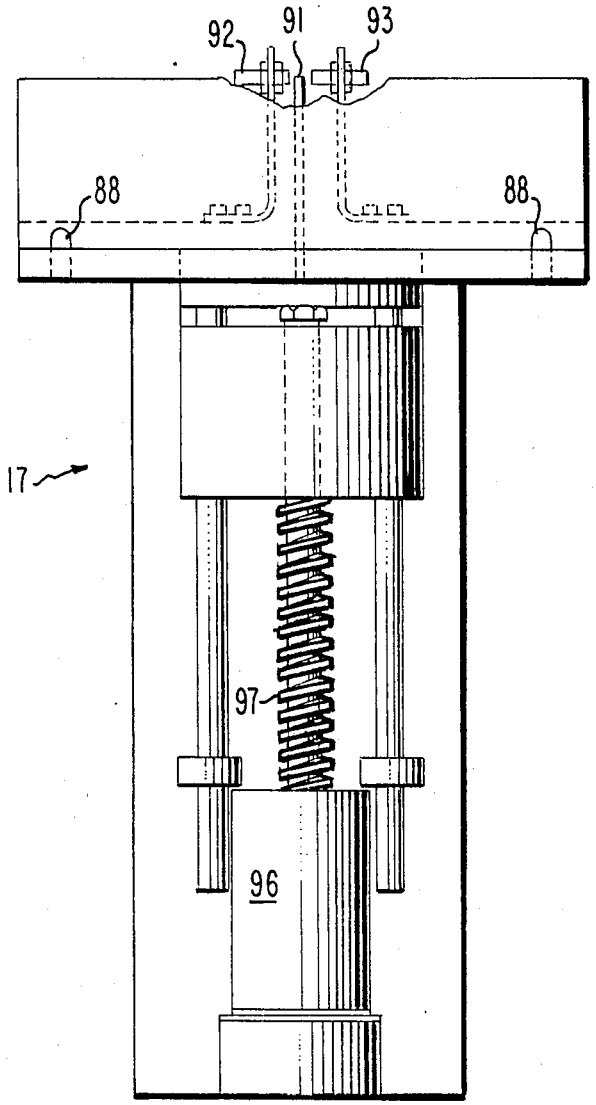
FIG. 5*b* is a front view of the device of FIG. 5*a*.
Figure 5C:
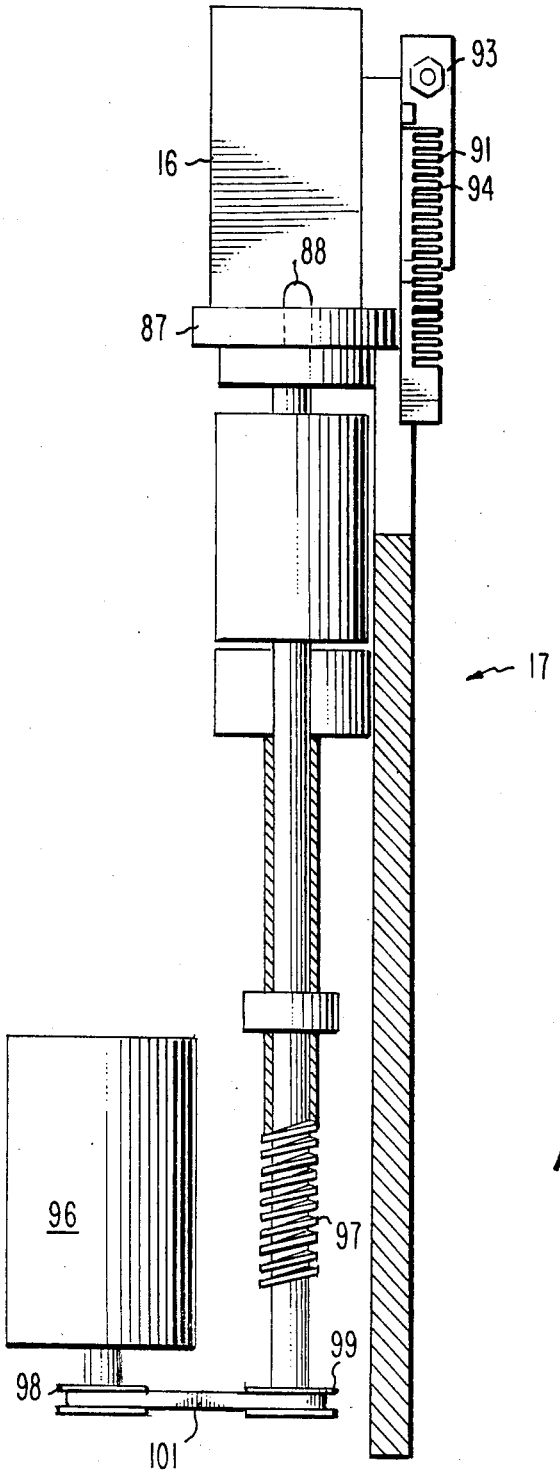
FIG. 5*c* is a side view of the device of FIG. 5*a*.

The moving means 17 for vertically moving the object container 16 is described in detail with respect to FIGS. 5*a*, 5*b* and 5*c*. The moving means 17 includes a base plate 87 which includes two positioning pins 88. The pins 88 are used to position a plate 89 accurately in the device 17. The plate 89 carries the object container 16. A container vertical position indicator 91 is positioned between an energy source 92 and an energy detector 93. The position indicator 91 preferably is a comb-like member having a plurality of teeth 94. The teeth, and the spaces between the teeth, are dimensioned in accordance with the thicknesses of the objects to be packed in the container 16. After a layer of objects is packed in the container 16, the container is moved downwardly to provide room for the next layer of objects to be placed in the container 16. The distance of movement is controlled by the thicknesses of the teeth 94, and the spaces between the teeth, of the comb 91. A motor 96, such as a dc motor or a stepping motor, drives a ballscrew 97 through pulleys 98, 99 and a belt 101. The motor 96 is energized for sufficient time to lower the base 77 one object thickness in accordance with the spacing between the teeth 94 of the comb 91.

In FIG. 1, after the container 16 is fully loaded a transfer device 102 is actuated. The transfer device 102 is similar to the transfer device 19 of FIG. 6 but is arranged so that the slide shafts are in a vertical plane. The transfer device 102 pushes an empty container 16*a* against the full container to push the full container 16 away from the loading area into the proximity of another transfer device 103, similar to device 19 of FIG. 6. The transfer device 103 is actuated to move the filled container 16*b* to provide room for the next container coming from the loading area. Another transfer device 104, which also is similar to the transfer device 19 of FIG. 6, is energized to move the supply of containers 16 into the proximity of the transfer device 102.

What is claimed is:

1. A system for aligning and packing substantially flat objects moving along a first conveyor nonaligned, and in irregularly spaced rows comprising:

a first mechanism for separating said rows of objects and for aligning said objects in rows substantially normal to said conveyor, said first mechanism including an elongated row separating member, and an elongated object aligning member, said elongated members extending substantially the full width of said first conveyor and substantially normal to said first conveyor, said row separating member having a high coefficient of friction for grasping a row of said objects and separating said row of objects from the other rows, said object aligning member engaging the edges of said objects to align all objects in said row, said first mechanism also feeding said objects onto a second conveyor;

a packing mechanism for transferring a preselected number of said objects from said second conveyor to a container located at a loading area;

container moving means for vertically moving said container a distance substantially equal to the thickness of said objects whereby a plurality of layers of objects are stacked in said container; and means for placing a strip of protective material between each of said layers of objects in said container.

2. The system of claim 1 further including first means for moving empty containers from a storage location to said loading area, and second means for moving empty containers from a storage area to said storage location.

3. The system of claim 1 wherein said elongated members are separately moveable from a position above said objects into contact with said objects whereby said row of objects is separated from the other rows prior to being aligned by said aligning member.

4. The system of claim 3 further including means for moving said elongated members substantially parallel to said first conveyor at a rate faster than the motion of said first conveyor.

5. The system of claim 4 further including first sensor means for detecting said rows of objects as said rows move into the proximity of said elongated row separating member.

6. The system of claim 5 wherein said first mechanism is pivotably mounted with respect to said first conveyor to facilitate servicing of said elongated members.

7. The system of claim 1 wherein said packing mechanism includes a pusher bar arranged substantially parallel to said second conveyor and moveable substantially normal to said second conveyor, and means for moving said pusher bar for transferring a preselected number of said objects to said container.

8. The system of claim 7 wherein said pusher bar includes a moveable end, for eliminating pressure between said objects prior to the transfer of said objects to said container.

9. The system of claim 8 further including an object stop arranged in the proximity of one end of said transfer bar whereby said object stop stops objects on said second conveyor when objects are being transferred to said container.

10. The system of claim 9 further including sensor means for sensing objects in the proximity of said pusher bar.

11. The system of claim 1 wherein said container moving means includes container position indicator means, said position indicator means having alternate energy transmission areas and energy opaque areas, said energy transmission and opaque areas being dimensioned in accordance with the thickness of said objects whereby movement from an area of one transmission capability to the next area of the same transmission capability is substantially equal to one thickness of said objects.

12. The system of claim 11 further including energy transmission means and energy detection means arranged on opposite sides of said position indicator means whereby motion of said container is detected by energy transmitted through said energy transmission areas.

13. The system of claim 12 further including a motor and ball screw for vertically moving said container.

14. The system of claim 1 wherein said means for placing a strip of material includes vacuum means for lifting and holding said strip from a supply source.

15. The system of claim 14 further including means for supplying a short burst of air to said supply for separating said strip from said supply.

16. The system of claim 4 further including first means for moving empty containers from a storage location to said loading area, and second means for moving empty containers from a storage area to said storage location.

17. The system of claim 6 wherein said packing mechanism includes a pusher bar arranged substantially parallel to said second conveyor and movable substantially normal to said second conveyor, and means for moving said pusher bar for transferring a preselected number of said objects to said container, said pusher bar having a movable end, for eliminating pressure between said objects prior to the transfer of said objects to said container.

18. The system of claim 17 further including an object stop arranged in the proximity of one end of said pusher bar whereby said object stop stops objects on said second conveyor when objects are being transferred to said container.

19. The system of claim 18 wherein said container moving means includes container position indicator means, said position indicator means having alternate energy transmission areas and energy opaque areas, said energy transmission means and said opaque areas being dimensioned in accordance with the thickness of said objects whereby movement from an area of one transmission capability is substantially equal to one thickness of said objects, and also including energy transmission means and energy detection means arranged on opposite side of said position indicator means whereby motion of said container is detected by energy transmitted through said position indicator means.

20. The system of claim 19 wherein said means for placing a strip of material includes vacuum means for lifting and holding said strip from a supply source, and means for supplying a short burst of air to said supply for separating said strip from said supply.

21. The system of claim 13 wherein said means for placing a strip of material includes vacuum means for lifting and holding said strip from a supply source.

22. The system of claim 21 further including means for supplying a short burst of air to said supply for separating said strip from said supply.

23. The system of claim 22 further including first means for moving empty containers from a storage location to said loading area, and second means for moving empty containers from a storage area to said storage location.

24. The system of claim 20 further including first means for moving empty containers from a storage location to said loading area, and second means for moving empty containers from a storage area to said storage location.

* * * * *